US007337697B2

(12) United States Patent
Bader et al.

(10) Patent No.: US 7,337,697 B2
(45) Date of Patent: Mar. 4, 2008

(54) DEPTH STOP DEVICE

(75) Inventors: Thomas Bader, Landsberg (DE); Matthias Keith, Buchloe (DE)

(73) Assignee: Hilti Aktiengesellschaft, Schaan (LI)

( * ) Notice: Subject to any disclaimer, the term of this patent is extended or adjusted under 35 U.S.C. 154(b) by 170 days.

(21) Appl. No.: 11/267,867

(22) Filed: Nov. 3, 2005

(65) Prior Publication Data

US 2007/0163397 A1 Jul. 19, 2007

(30) Foreign Application Priority Data

Nov. 4, 2004 (DE) ..... 10 2004 053 250

(51) Int. Cl.
*B25B 23/00* (2006.01)

(52) U.S. Cl. ..... 81/54; 81/52; 81/429; 408/113

(58) Field of Classification Search ..... 81/52, 81/54, 429; 408/113, 202, 241 S
See application file for complete search history.

(56) References Cited

U.S. PATENT DOCUMENTS 3,712,352 A * 1/1973 Lafferty, Sr. ..... 81/429
4,647,260 A * 3/1987 O'Hara et al. ..... 408/241 S
5,044,233 A * 9/1991 Tatsu et al. ..... 81/429
5,341,704 A * 8/1994 Klemm ..... 81/429
5,380,132 A * 1/1995 Parks ..... 408/113
5,601,387 A * 2/1997 Sanford et al. ..... 408/113
6,499,381 B2 * 12/2002 Ladish et al. ..... 81/429

* cited by examiner

*Primary Examiner*—Joseph J. Hail, III
*Assistant Examiner*—Anthony Ojini
(74) *Attorney, Agent, or Firm*—Abelman, Frayne & Schwab

(57) ABSTRACT

A depth stop device for a screw driving tool includes an adjusting ring (30), a connection sleeve (22) for rotatably mounting the adjusting ring (30) on the nose member (6) of the screw driving tool housing (4), a substantially sleeve-shaped depth stop (36) displaceable in an axial direction relative the connection sleeve (22) by rotation of the adjusting ring (30), and at least partially elastic locking element (40) engageable in the axial direction with both the adjusting ring (30) and the connection sleeve (22), the locking element being also adapted to secure the adjusting ring (30) on the connection sleeve (22) in a rotational direction (D).

18 Claims, 3 Drawing Sheets

DEPTH STOP DEVICE

BACKGROUND OF INVENTION

1. Field of Invention

The present invention relates to a depth stop device for setting a desired drive-in depth for a to-be-driven-in fastening element that is driven in by a motor-driven screw driving tool, and mountable on a nose member of the screw driving tool housing which is connected with a working tool holder for joint rotation therewith. The depth stop device includes an adjusting ring rotationally mountable on the nose member of the tool housing with a connection sleeve that can be formed as a separate member or as a part of the tool housing. The depth stop device further includes a substantially sleeve-shaped depth stop displaceable in an axial direction relative the connection sleeve by rotation of the adjusting ring, means for rotationally securing the adjusting ring on the connection sleeve until an adjusting torque in a rotational direction is applied to the adjusting ring by a screw driving tool user, and means for securing the adjusting ring on the connection sleeve in the axial direction.

2. Description of Prior Art

Depth stop device of the type described above are used for preliminary setting, in a known manner, of a maximal drive-in depth of a fastening element, such as, in particular, a screw that is being driven in workpiece by a screw driving tool. Upon reaching a predetermined depth, the torque transmission from the motor to the chuck is usually interrupted by separation of a friction clutch. The depth stop device is removable from the screw driving tool in order to be able to use the screw driving tool without the depth stop device or in order to replace a screw bit.

U.S. Pat. No. 5,380,132 discloses a depth setting system for a power-driven screw driving tool in which the adjusting ring has, at its end remote from the working tool, two resilient hook elements. Upon mounting, the hook elements snap behind a circumferential rib formed on the screw driving tool housing. On the circumference of the adjusting ring, there are provided a plurality of indentation which engage, in a plurality of rotational positions of the adjusting ring relative to the housing, respective elevation provided on a nose member that is screwed to the housing.

With the above-described design of the depth setting system, the axially and rotationally securing means is formed essentially by different resilient elements of the adjusting ring and which cooperate with respective correspondingly formed, shaped elements.

The drawback of the known depth setting system consists in that the adjusting ring has a very expensive construction due to a large number of resilient elements formed thereon. In addition, the repeated engagement of the indentation of the adjusting ring with the elevation of the nose member leads to excessive wear of these elements, which results in a relatively short service life of the rotationally securing means.

Accordingly, the object of the present invention is to provide a depth stop device in which the drawback of the prior art device are eliminated.

Another object of the present invention is to provide a depth stop device that would insure a stable axial locking of the depth stop at a releasable mounting of the device on the screw driving tool and a rotational locking of the depth stop for a reliable setting of the preset position of the depth stop relative to the screw driving tool housing.

A further object of the present invention is to provide an easily mountable depth stop device that has reduced manufacturing costs.

SUMMARY OF THE INVENTION

These and other objects of the present invention, which will become apparent hereinafter, are achieved by providing axially securing means that includes a separate, from the adjusting ring and the connection sleeve, at least partially elastic locking element engageable in the axial direction with both the adjusting ring and the connection sleeve.

Such resilient locking element can be formed separately from the adjusting ring and the connection sleeve. This substantially simplifies the construction of both the adjusting ring and the connection sleeve, which substantially reduces manufacturing costs. Further, the resiliency of the locking element at the same time simplifies mounting of the depth stop device on the screw driving tool.

According to an advantageous embodiment of the present invention, the adjusting ring has at least one receiving recess in which the locking element is formlockingly received in the axial direction. The locking element has at least one elastic element lockingly engageable with a counter-locking element provided on the connection sleeve. Thereby, a simplified and stable mounting of the adjusting ring on the connection sleeve and, thereby, a stable axial position of the depth stop relative to the housing is insured.

Preferably, the locking element is formed as a U-shaped element, and the counter-locking means is formed as a circumferential groove. With the locking element being formed as a U-shaped element, both free legs thereof acts as spring arms that snap in respective locking receptacles upon mounting. This insures a particular easy mounting.

Advantageously, the locking element is formed of wire, which reduces wear, on one hand, and on the other hand, insures a particularly economical manufacturing of the locking element.

Advantageously, the connection sleeve has a cone section extending sidewise of the circumferential groove in a direction of the working tool end of the connection sleeve and tapering in the direction of the working tool end. Thereby, upon mounting of the adjusting ring on the connection sleeve, the locking element is automatically expanded by the conical section and subsequently snaps into the receiving groove. This further simplifies mounting of the depth stop device.

Advantageously, the rotationally securing means includes a bearing profile provided on the connection sleeve on which the locking element is supported without a possibility of rotation relative thereto until an adjusting stroke is applied to the locking element. Thereby, the locking element forms part of both the axially securing means and the rotationally securing means. This reduces the number of separate components of the depth stop device, which again simplifies mounting and reduces manufacturing costs.

Advantageously, the bearing profile is formed by the bottom of the circumferential groove. Thereby, both the axial and the rotational securing means for securing the adjusting ring with the connection sleeve are formed by the locking element held on the adjusting ring and the receiving groove of the connection sleeve. In this way, both securing means can be easily mounted, require a minimal mounting space, and less components are required for their formation.

Advantageously, the receiving groove bottom has a hexagonal cross-section, which insures, on one hand, a sufficiently large support surface for the adjusting ring in each rotational position of the adjusting ring and, on the other hand, a sufficiently precise setting of the drive-in depth.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
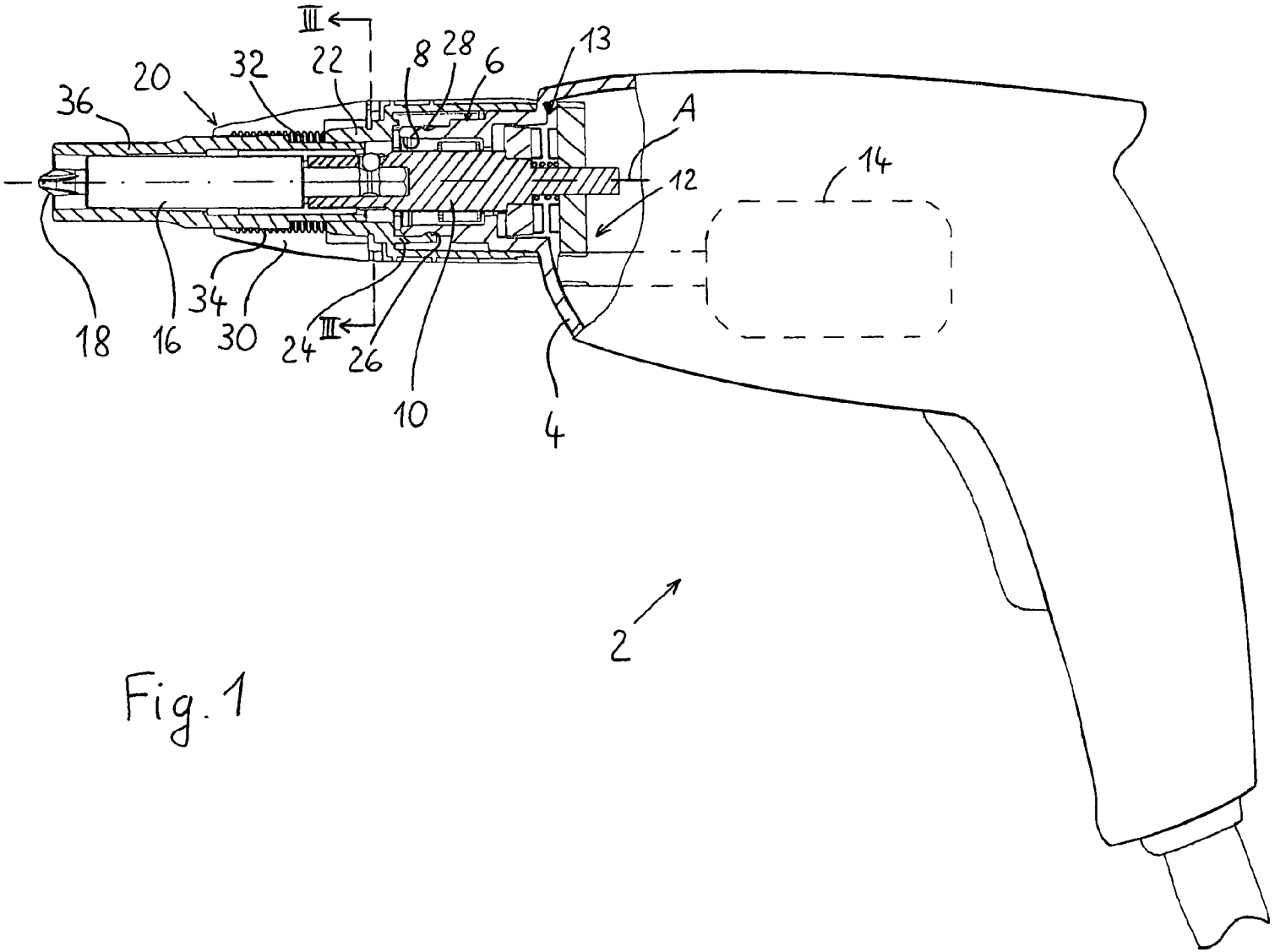
FIG. 1 a side, partially cross-sectional view of a screw driving tool with a depth stop device according to the present invention.

A screw driving tool 2, which is shown in FIG. 1, is formed as a screw driving tool for use in a dry constructional technology and includes a housing 4 with a nose member 6 having an opening 8. An axially displaceable working tool spindle 10, which is rotationally driven about an axis A by a motor 14 via a gear 12 connected with the motor 14 by a friction coupling 13, extends through the opening 8. A working tool holder 16, in which a bit 18 for driving in a screw, not shown, is inserted, is connected to the working tool spindle 10 for joint rotation therewith.

In order to be able to preliminarily adjust the drive-in depth of a screw, there is mounted on the nose member 6 a depth stop device generally designated with a reference numeral 20. The depth stop device 20 includes a connection sleeve 22 with a plurality of spring arms 24 at free ends of which there are provided, respectively, locking elements 26. In order to secure the connection sleeve 22 on the housing 4, the sleeve 22 is pushed over the nose member 6. When the sleeve 22 is pushed over the nose member 6, the locking elements first pivot sidewise and then snap into a circumferential locking groove 28 formed in the nose member 6. Alternatively to this or a similar locking connection, the connection sleeve 22 can be connected with the housing 4 by a screw or even be formed as one-piece with the housing 4.

The depth stop device 20 further includes an adjusting ring 30 supported on the connection sleeve 22 for rotation about the axis A. The adjusting ring 30 has an inner thread 32 that cooperates with an outer thread 34 of a sleeve-shaped depth stop 36 that is screwed into the adjusting ring 30.

Figure 2:
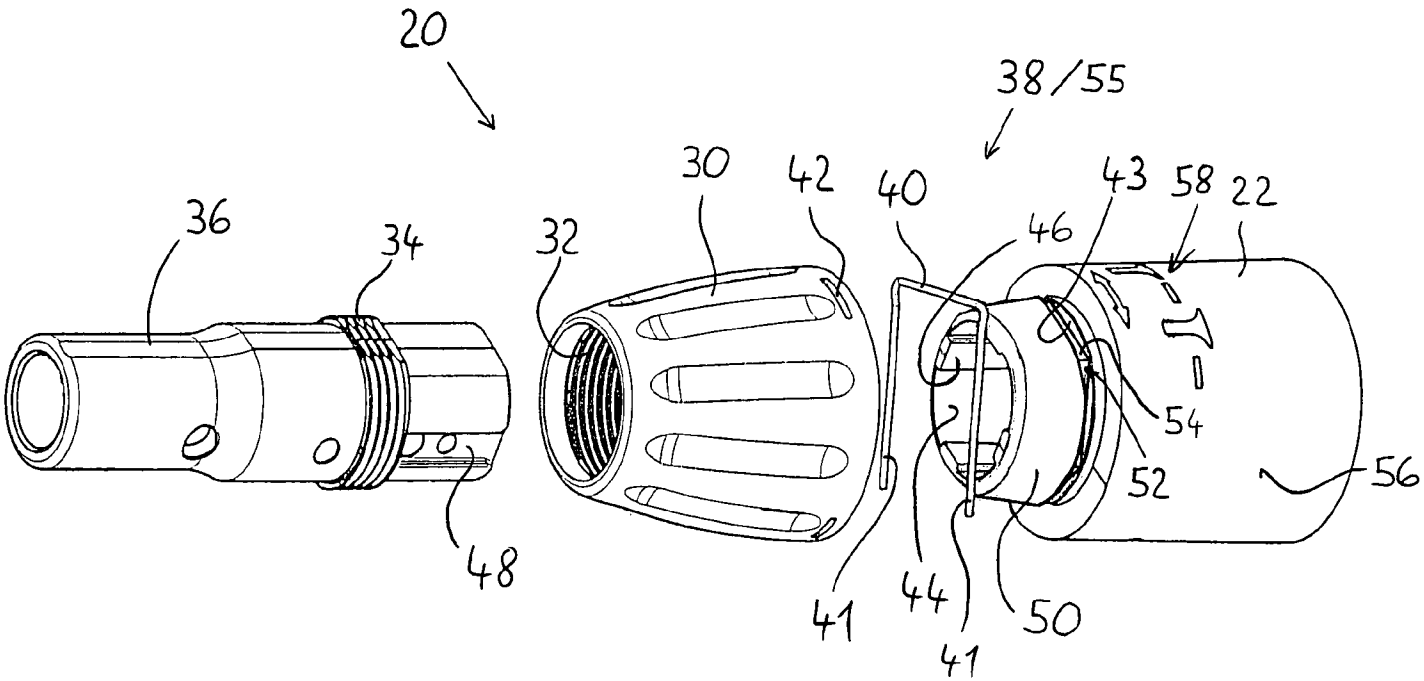
FIG. 2 an exploded perspective view of a depth stop device according to the present invention.
Figure 3:
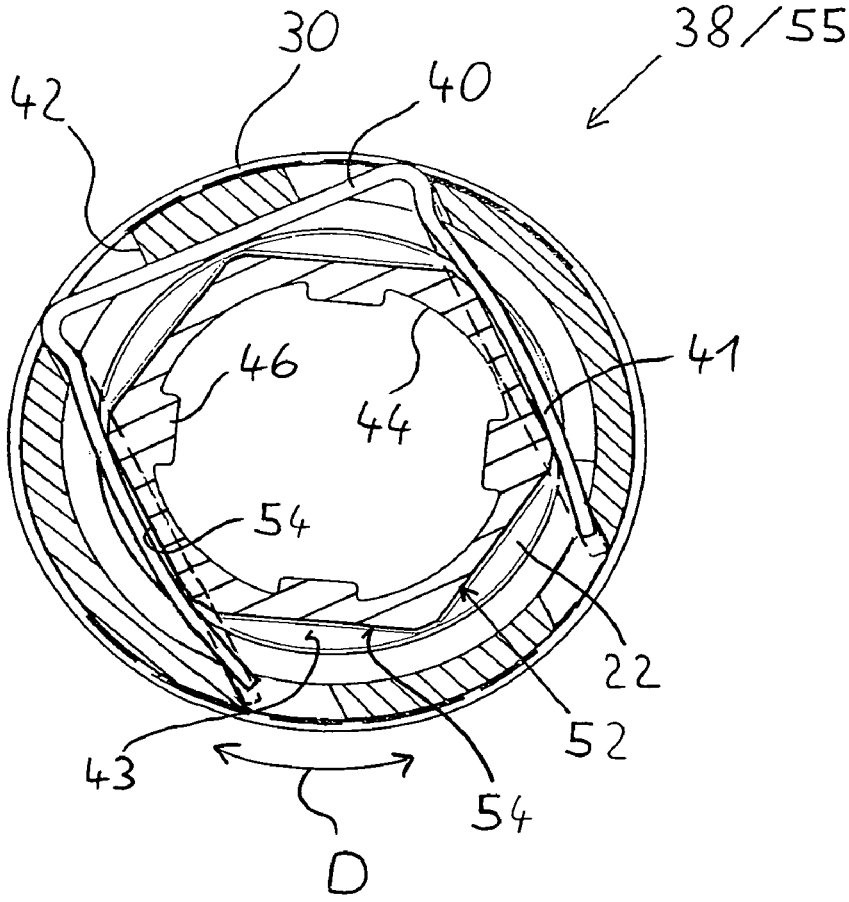
FIG. 3 a cross-sectional view along line III-II in FIG. 1 in a region of axial and rotational locking means in a connection condition of the connection sleeve with the adjusting ring.

As shown in FIGS. 2-3, for axially securing the adjusting ring 30 on the connection sleeve 22, there is provided axially securing means generally designated with a reference numeral 38. The axially securing means 38 has a U-shaped locking element 40 that is formed of spring wire. The locking element 40 has two spring legs 41 that forms locking means for axially securing the adjusting ring 30. The axially securing means 38 further includes two receiving recesses 42 in form of break-through openings in which portions of the locking element 40 can be received to formlockingly secure the adjusting ring 30 both in axial direction and rotational direction D. In addition, the axially securing means 38 includes counter-locking means in form of a circumferential groove 43 formed on the connection sleeve 22.

As further shown in FIGS. 2-3, the connection sleeve 22 has a longitudinal bore 44 for partially receiving the depth stop 36. In the longitudinal bore 44, there are provided longitudinal ribs 46 that cooperate with longitudinal grooves 48 which are formed on the depth stop 36, as shown in FIG. 2.

When the depth stop device 20 is mounted on the screw driving tool 2, first, the depth stop 36 is inserted into the adjusting ring 30, with the outer thread 34 of the depth stop 36 being screwed with the inner thread 32 of the adjusting ring 30. The locking element 40 is inserted in the break-through openings 42. Then, the adjusting ring 30 is pushed over the connection sleeve 22, with the longitudinal ribs 46 engaging in the longitudinal grooves 48 of the depth stop 36, whereby the rotation of the depth stop 36 relative to the connection sleeve 22 is prevented. Simultaneously, the spring legs 41 of the locking element 40, which is held in the adjusting ring 30, are spread by a cone section 50 of the connection sleeve 22 and which tapers in a direction toward the working tool end of the connection sleeve 22, and finally snap into the receiving groove 43. The axially securing means 38 becomes closed, and the adjusting ring 30 is axially secured on the connection sleeve 22.

As still further shown in FIGS. 2-3, the receiving grove 43 has a bottom 52 having a hexagonal profile with six bearing sides 54. In the mounted condition, both spring legs 41 are pressed against respective bearing sides 54 as a result of an elastic restoration after being spread by the cone section 50 of the connection sleeve 22. Thereby the spring element 40 supports the adjusting ring 30 with both spring leg 41 on the bottom 52 in the rotational direction D.

In this way, the spring element 40 forms, together with the receiving recesses 42 and the bearing sides 54 of the bottom 52 of the receiving groove 43, means for rotationally securing the adjusting ring 30 on the connection sleeve 22 and which is generally designated with a reference numeral 55. The rotationally securing means 55 prevents an unintended rotation of the adjusting ring 30 from an adjusting position, which is defined by the position of the depth stop 36 for a predetermined drive-in depth, until a new adjusting torque is applied by a tool user. Upon application of an adjusting torque by the user, the spring element legs 41 are spread by the hexagonal profile of the bottom 52 and spring from one pair of bearing sides 54 to another pair of bearing sides 54. This displacement of the spring element 40 provides for rotation of the adjusting ring 30 relative to the depth stop 36 that is secured on the connection sleeve 22 without a possibility of rotation due to cooperation of the longitudinal ribs 46 of the connection sleeve 22 with the longitudinal groves 48 of the depth stop 36. Due to the cooperation of the engaging in each other, inner thread 32 of the adjusting ring 30 and the outer thread 34 of the depth stop 36, the depth stop 36 is axially displaced relative to the connection sleeve 22 and the housing 4. Thereby, with the friction clutch 13 being disengaged, a new drive-in depth is set.

On the outer surface 56 of the connection sleeve 22, a direction marking 58 is provided to indicate in which of rotational directions D of the adjusting ring 30 the drive-in depth decreases or increases.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A depth stop device (20) for a motor-driven screw driving tool (2) including a housing (4) having a nose member (6) connected with a working tool holder (16) for joint rotation therewith, the depth stop device (20) comprising:

an adjusting ring (30);

a connection sleeve (22) separate from the nose member (6) for rotatably mounting the adjusting ring (30) on the nose member (6);

a substantially sleeve-shaped depth stop (36) displaceable in an axial direction relative the connection sleeve (22) by rotation of the adjusting ring (30);

means (55) for rotationally securing the adjusting ring (30) on the connection sleeve (22) until an adjusting torque in a rotational direction (D) is applied to the adjusting ring (30) by a screw driving tool user; and means (38) for securing the adjusting ring (30) on the connection sleeve (22) in the axial direction, the securing means (38) including a locking element (40) separate from the adjusting ring (30) and with the locking element (40) engageable in the axial direction with both the adjusting ring (30) and the connection sleeve (22).

2. A depth stop device according to claim 1, wherein the adjusting ring (30) has at least one receiving recess (42) in which the locking element (40) is formlockingly received in the axial direction, and wherein the locking element (40) has at least one elastic element lockingly engageable with counter-locking means provided on the connection sleeve (22).

3. A depth stop device according to claim 2, wherein the locking element (40) is formed as a U-shaped element, and wherein the counter-locking means is formed as a circumferential groove (43).

4. A depth stop device according to claim 3, wherein the connection sleeve (22) has a cone section (50) extending sidewise of the circumferential groove (43) in a direction of the working tool end of the connection sleeve (22) and tapering in the direction of the working tool end.

5. A depth stop device according to claim 1, wherein the locking element (40) is formed of wire.

6. A depth stop device according to claim 1, wherein the rotationally securing means (55) includes a bearing profile provided on the connection sleeve (22) on which the locking element (40) is supported without a possibility of rotation relative thereto until an adjusting stroke is applied to the locking element (40).

7. A depth stop device according to claim 6, wherein the bearing profile is formed by a bottom (52) of a circumferential groove (43) of the connection sleeve (22).

8. A depth stop device according to claim 7, wherein the bottom (52) has a hexagonal cross-section.

9. A depth stop device (20) for a motor-driven screw driving tool (2) including a housing (4) having a nose member (6) connected with a working tool holder (16) for joint rotation therewith, the depth stop device (20) comprising:

an adjusting ring (30);

a connection sleeve (22) separate from the nose member (6) for rotatably mounting the adjusting ring (30) on the nose member (6);

a substantially sleeve-shaped depth stop (36) displaceable in an axial direction relative the connection sleeve (22) by rotation of the adjusting ring (30);

means (55) for rotationally securing the adjusting ring (30) on the connection sleeve (22) until an adjusting torque in a rotational direction (D) is applied to the adjusting ring (30) by a screw driving tool user, wherein the means (55) for rotationally securing includes a partially elastic locking element (40) separate from the adjusting ring (30) and with the locking element (40) engageable in the axial direction with both the adjusting ring (30) and the connection sleeve (22); and means (38) for securing the adjusting ring (30) on the connection sleeve (22) in the axial direction.

10. A depth stop device according to claim 9, wherein the rotationally securing means (55) includes bearing sides (54) on a bottom (52) of a receiving groove (43); and wherein the partially elastic locking element (40) together with recesses (42) on the adjusting ring (30) and the bearing sides (54) on the bottom (52) of the receiving groove (43) form the means (55) for rotationally securing the adjusting ring (30) on the connection sleeve (22).

11. A depth stop device according to claim 10, wherein the bottom (52) has a hexagonal cross-section.

12. A depth stop device according to claim 9, wherein the adjusting ring (30) has at least one receiving recess (42) in which the locking element (40) is formlockingly received in the axial direction, and wherein the locking element (40) has at least one elastic element lockingly engageable with counter-locking means provided on the connection sleeve (22).

13. A depth stop device according to claim 12, wherein the locking element (40) is formed as a U-shaped element, and wherein the counter-locking means is formed as a circumferential groove (43).

14. A depth stop device according to claim 13, wherein the connection sleeve (22) has a cone section (50) extending sidewise of the circumferential groove (43) in a direction of the working tool end of the connection sleeve (22) and tapering in the direction of the working tool end.

15. A depth stop device according to claim 9, wherein the locking element (40) is formed of wire.

16. A depth stop device according to claim 9, wherein the rotationally securing means (55) includes the bearing sides (54) provided on the connection sleeve (22) on which the locking element (40) is supported without a possibility of rotation relative thereto until an adjusting stroke is applied to the locking element (40).

17. A depth stop device according to claim 16, wherein the bearing sides (54) are formed by a bottom (52) of a circumferential groove (43) of the connection sleeve (22).

18. A depth stop device according to claim 17, wherein the bottom (52) has a hexagonal cross-section.

* * * * *